US006713738B2

(12) United States Patent
Yau et al.

(10) Patent No.: US 6,713,738 B2
(45) Date of Patent: Mar. 30, 2004

(54) METHODS FOR TEMPERATURE CONTROL IN MICROWAVE PROCESSING

(75) Inventors: John K. F. Yau, Kowloon (HK); Tony F. L. Kwong, Kowloon (HK)

(73) Assignee: City University of Hong Kong, Kowloon (HK)

( * ) Notice: Subject to any disclaimer, the term of this patent is extended or adjusted under 35 U.S.C. 154(b) by 129 days.

(21) Appl. No.: 10/102,263

(22) Filed: Mar. 19, 2002

(65) Prior Publication Data

US 2003/0178417 A1 Sep. 25, 2003

(51) Int. Cl.[7] ..... H05B 6/64

(52) U.S. Cl. ..... 219/678; 219/679; 505/480; 264/405; 264/489

(58) Field of Search ..... 219/678, 679; 505/480, 500, 501; 264/402, 405, 427, 428, 489, 490

(56) References Cited

U.S. PATENT DOCUMENTS 4,536,242 A * 8/1985 Gripenholt et al. ..... 156/96
5,380,702 A * 1/1995 Henty ..... 505/480
6,172,346 B1 * 1/2001 Wroe ..... 219/681

OTHER PUBLICATIONS

D. R. Baghurst and D. M. P. Mingos, "Application of microwave heating techniques for the synthesis of solid state inorganic compounds," J. Chem. Soc., Chem. Commun., 12 829–830 (1988).

D. R. Baghurst, A. M. Chippindale and D. M. P. Mingos, "Microwave syntheses for superconducting ceramics," Nature, 332 311 (1988).

H. Feldstein, L. Ben–Dor and V. Beilin, "Microwave synthesis of high Tc superconductors," Physica C, 235–240 929–930 (1994).

M. A. Janney, H. D. Kimrey, M. A. Schmidt and J. O. Kiggans, "Grain growth in microwave–annealed alumina," J. Am. Ceram. Soc., 74 [7] 1675–1681 (1991).

V. I. Kojuharoff, "Synthesis of high–temperature superconducting thin films in microwave field," J. Appl. Phys., 75 [10] 6972–6974 (1994).

K. Naitoh, T. Takizawa and T. Matsuse, "Controlled microwave irradiation for the synthesis of YBa2Cu3O7–x superconductors," Jpn. J. Appl. Phys. Part 2, 38 [7A] L724–L726 (1999).

A. Cherradi, S. Marinel, G. Desgardin, J. Provost and B. Raveau, "Microwave sintering of the high–Tc superconductor Y–Ba–Cu–O," Supercond. Sci. Technol., 10 475–483 (1997).

J. G. P. Binner and I. A. H. Al–Dawery, "Microwave melt texturing of bulk YBCO superconductors," Supercond. Sci. Technol., 11 1230–1236 (1998).

M. Kato, K. Sakakibara and Y. Koike, "Rapid preparation of high–Tc superconductors of the Bi–2212 phase using a domestic microwave oven," Jpn. J. Appl. Phys. Part 1, 38 [10] 5867–5868 (1999).

S. Marinel, G. Desgardin, J. Provost and B. Raveau, "A microwave melt texture growth process of YBa2Cu3O7–d" Mater. Sci. & Eng. B, 52 47–54 (1998).

B. Vaidhyanathan and K. J. Rao, "High microwave susceptibility of NaH2PO4•2H2O: rapid synthesis of crystalline and glassy phosphates with NASICON–type chemistry," J. solid state chem., 132 [2] 349–354 (1997).

(List continued on next page.)

*Primary Examiner*—Philip H. Leung
(74) *Attorney, Agent, or Firm*—Heslin Rothenberg Farley & Mesiti P.C.; John Pietrangelo

(57) ABSTRACT

Methods for temperature control in microwave processing of materials, for example microwave sintering, annealing and other forms of microwave heating, are disclosed in which the material is formed into a selected shape and size such that at least a part of the materials reaches a state of thermal equilibrium at a desired temperature.

9 Claims, 8 Drawing Sheets-

OTHER PUBLICATIONS

J. G. P. Binner and I. A. H. Al–Dawery, "Bulk YBCO high–Tc superconductors with uniform and full oxygen content via microwave processing," Supercond. Sci. Technol., 11 449–457 (1998).

W. H. Sutton, "Microwave processing of ceramic materials", Ceramic Bull., 68 [2] 376–386 (1989).

B. Gebhart, Heat conduction and mass diffusion, McGraw–Hill, Inc., New York, (1993).

* cited by examiner (a)

(b)

(c)

METHODS FOR TEMPERATURE CONTROL IN MICROWAVE PROCESSING

FIELD OF THE INVENTION

This invention relates to methods for temperature control in microwave processing, and in particular though not exclusively to such methods that enable temperature control during microwave heating, sintering or annealing. The invention further relates to methods for forming desired materials by microwave heating of precursor materials.

BACKGROUND OF THE INVENTION

Microwave heating has been proposed for many thermal processing techniques such as heating, sintering and annealing because of its efficiency and speed, and also because of the fact that different materials have different microwave absorption properties leading to the possibility of new fabrication techniques. The major advantages of microwave heating are in particular a fast heating rate and selective heating. If the microwave frequency is chosen correctly, for example, it is possible to heat a sample to a high temperature within a container that is not susceptible to heating and therefore remains at low temperature.

For example, copper oxide can be heated from room temperature to over 1000° C. in a matter of seconds by microwave heating at a frequency of 2.45 GHz. This can be used for example in microwave sintering of high temperature superconducting $YBa_2Cu_3O_{7-x}$ (Y123) the precursor of which includes approximately 27% by weight copper oxide. This can be carried out in an alumina container because alumina does not absorb at 2.45 GHz, but only at 28 GHz and therefore the container remains relatively cool. This selective heating property is particularly useful, for example, in thin film forming. For example, conventional heating makes it very difficult to heat thin films on a substrate because the substrate will also be heated which can lead to contamination of the thin film through diffusion of substrate components.

Unfortunately there are also some difficulties with microwave heating, and in particular with the control of the temperature during heating. Indeed even temperature measurement itself presents problems. For example, the temperature probe must not itself be susceptible to microwave heating at the same frequency as the samples being heated. Furthermore, if a metal probe is used it must be earthed or it may be damaged by arcing. In addition, since microwave absorption is material dependent, the heat generated by the microwave irradiation and hence the temperature achieved will vary with materials even if the same set-up and power is employed.

PRIOR ART

Current techniques for monitoring the temperature of samples during microwave heating include earthed thermocouples and infra-red pyrometers. For both methods, however, large errors are inevitable in comparison with conventional heating because of the larger temperature differences between the samples and the temperature sensing devices. Moreover, even if the temperature can be controlled, for example manually or by a complicated proportional-integrated-derivative (PID) control, temperature fluctuation can often be problematically large.

Some materials, such as $NaH_2PO_4.H_2O$, reach a naturally stable temperature (in this case 820K) after dehydration, however the class of such materials having the potential for natural isothermal heating is small.

There remains a need for methods for temperature control in microwave processing that would facilitate microwave heating and mitigate some of the aforesaid problems and difficulties.

SUMMARY OF THE INVENTION

According to the present invention there is provided a method of processing a sample of material by microwave irradiation, wherein the sample is formed such that at least a part of the sample will reach a state of thermal equilibrium in which energy absorbed from the microwave irradiation is balanced by heat dissipated to the environment.

In particular the maximum temperature of the sample at which the state of thermal equilibrium is reached is controlled by varying sample parameters selected from the shape, dimensions, mass and density of the sample. In a preferred embodiment of the invention the sample is formed as a cone.

According to another aspect of the present invention there is also provided a method of forming a material by microwave heating, comprising the steps of:

(a) assembling precursor materials into a shape of selected form and dimensions, at least one of said precursor materials being susceptible of absorbing microwave radiation at at least one microwave frequency, and (b) irradiating said precursor materials with microwave radiation at said at least one frequency, wherein the form and dimensions of the shape into which the precursor materials are selected is chosen such that when said materials are subject to said microwave irradiation at least a part of said sample reaches a state of thermal equilibrium at which at least a part of said precursor materials are at a temperature sufficient to form said material.

Preferably the precursor materials are formed into the shape of a cone.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

In the following description of a preferred embodiment of the invention, a method of temperature control in microwave processing will be described in which the mass, density, shape and dimensions of the sample to be processed are controlled so as to ensure that a state of thermal equilibrium is obtained whereby the heat absorbed from microwave irradiation is balanced by the heat loss to the surrounding environment. By appropriately selecting the mass, density, shape and dimensions of the sample, the temperature at which this equilibrium is reached can be adjusted.

Figure 1:
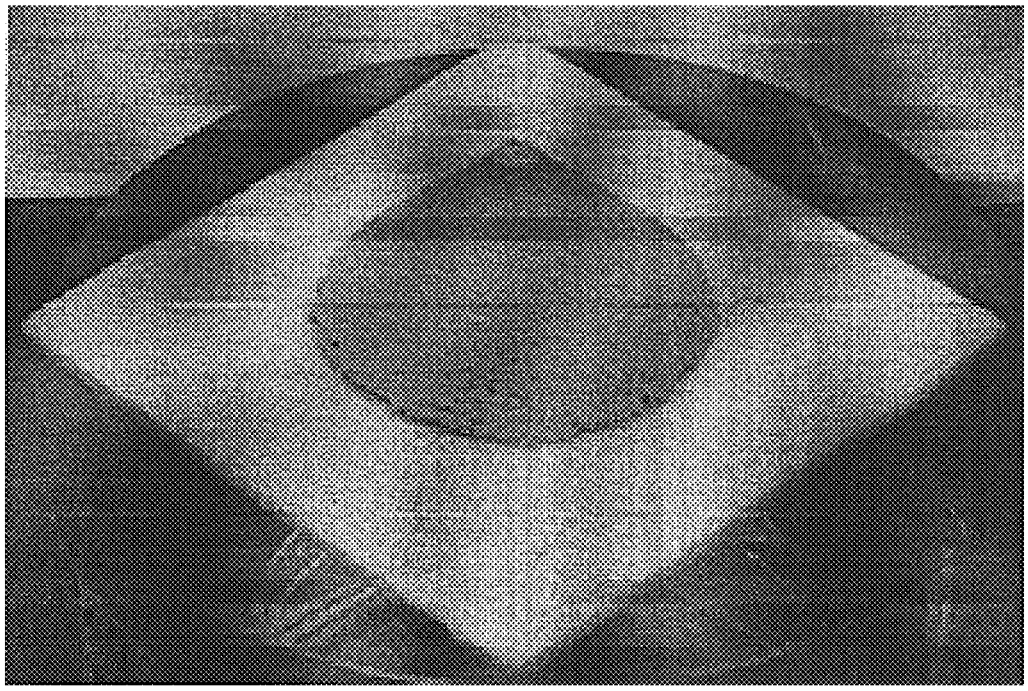
FIG. 1 illustrates a cone of powder material on a supporting plate.

In the following detailed example of the invention, the sample is formed into the shape of a cone. FIG. 1 shows such a sample formed as a cone. When a sample such as a precursor powder of Bi2212, with a microwave absorption component CuO is irradiated by microwave radiation, the absorbed energy heats the other components in the whole sample. Meanwhile, heat is conducted to the surface of the sample and then dissipated to the environment through radiation. The rate of heat loss depends on the temperature difference between the sample surface and the environment. In the case of a sample of cone shape powder (such as is shown in FIG. 1), a smaller cone would reach a lower ceiling temperature or temperature at equilibrium at its center, since it is easier to dissipate heat by first conduction through its interior, via a shorter distance, to the surface and then through radiation to the environment. By the same argument, a larger cone would reach a higher ceiling temperature at its center. Hence, by adjusting the size or, equivalently, in the case of fixed density, the mass of the cone, a desired temperature is achievable at the center of the sample. The following is a theoretical explanation using finite element analysis of how the heat distribution within the cone may be calculated as a function of time.

Figure 2:
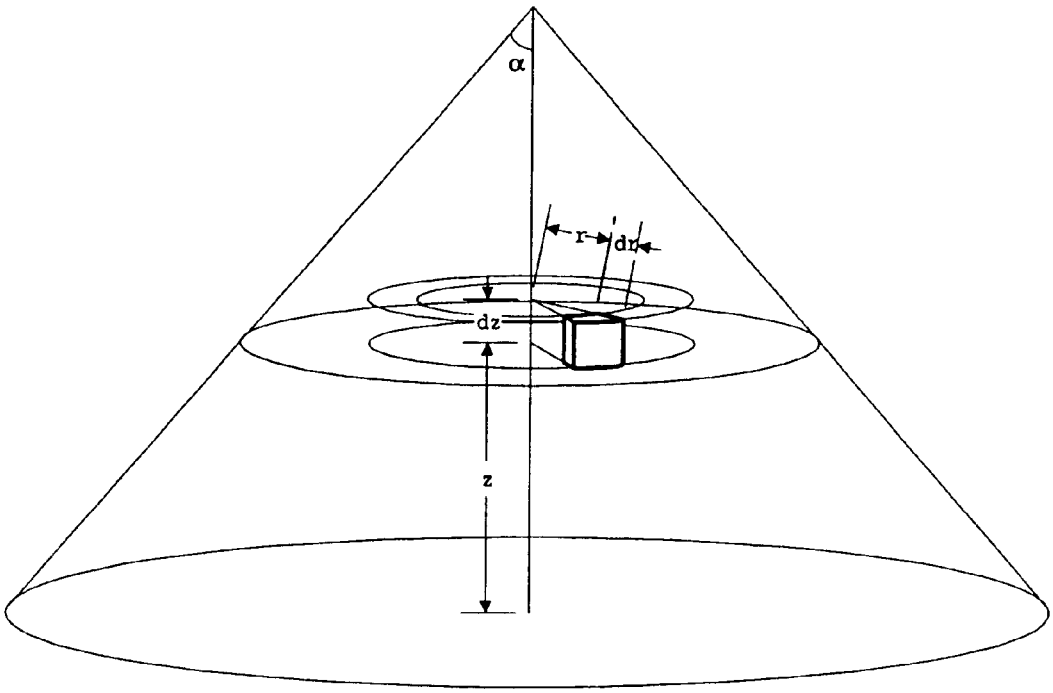
FIG. 2 is a schematic diagram illustrating the method of numerical computation.

A cylindrical coordinate system is employed to describe the position of any element that the cone composes of. The origin of the system is positioned at the center of the base of the cone (FIG. 2). Consider an element with mass m located at a height z in the axial direction and a distance r in the radial direction, as shaded in gray in the figure, the rate of heat absorption $Q_{abs}$ is proportional to the mass m, or, $$\frac{dQ_{\text{abs}}}{dt} \propto m(r, z) \tag{1}$$

Hence, $$\frac{dQ_{\text{abs}}}{dt} = \beta m(r, z)$$

where β is the effective microwave absorption and m(r,z) is the mass of the element.

(1) Heat Flow in the Radial Direction

Due to symmetry, the heat energy flows per unit time into and out of an element is independent of θ and only depends on z and r. The net heat energy flow in the r direction per unit time into an element, can be expressed as $$\frac{dQ_{ex-r}}{dt}:$$

$$\frac{dQ_{ex-r}}{dt} = \begin{cases} 0 & \text{for} \quad r = 0 \\ \dfrac{k_{air}(T)A_r dT}{dr} & \text{for} \quad 0 < r < (h-z)\tan\alpha \\ \sigma A_{r+dr}(T_i^4 - T_s^4) & \text{for} \quad r = (h-z)\tan\alpha \end{cases} \tag{2}$$

where $k_{air}(T)$ is the temperature-dependent coefficient of thermal conductivity of air,
$A_r$ is the cross sectional area at position r,
$A_{r+dr}$ is the cross sectional area at position r+dr,
dT is the temperature difference between two elements,
σ is Stefan-Boltzmann constant,
dr is the edge-to-edge distance between two elements,
h is the height of the cone,
α is the half solid angle of the cone,
$T_i$ is the temperature of the element at time t, and
$T_s$ is the temperature of the oven chamber at time t.

For an element located inside the bulk of the cone, i.e. 0<r<(h−z)tan α, heat flow is dominated by conduction, which can be derived from Fourier's law of thermal conduction. For an element on the surface of the cone, i.e. r=(h−z)tan α, heat flow is dominated by radiation.

(2) Heat Flow in the Axial Direction

In the axial or the z direction, heat flow per unit time is given by:

$$\frac{dQ_{ex-z}}{dt} = \begin{cases} \dfrac{k_{air}(T)A\left(T_i - \dfrac{k_{air}(T)T_i - k_{Al_2O_3}(T)T_a}{k_{Al_2O_3}(T) - k_{air}(T)}\right)}{dz} & \text{for} \quad z = 0 \\ \dfrac{k_{air}(T)A_z dT}{dz} & \text{for} \quad 0 < z < h \text{ and } 0 < r < (h-z)\tan\alpha \\ \sigma A_z(T_i^4 - T_s^4) & \text{for} \quad z = h \text{ or } r = (h-z)\tan\alpha \end{cases} \tag{3}$$

where dz is the height of the element,
$k_{Al_2O_3}(T)$ is the temperature-dependent thermal conductivity of the $Al_2O_3$ plate,
$T_a$ is the temperature of the $Al_2O_3$ plate, and
$A_z$ is the surface area of the element in position z.

The heat exchange at z=0 is derived from Fourier's equation of thermal conduction between two different media, i.e. the powder that composes the cone and the $Al_2O_3$ plate that supports the cone in the examples that will follow below.

Figure 5:
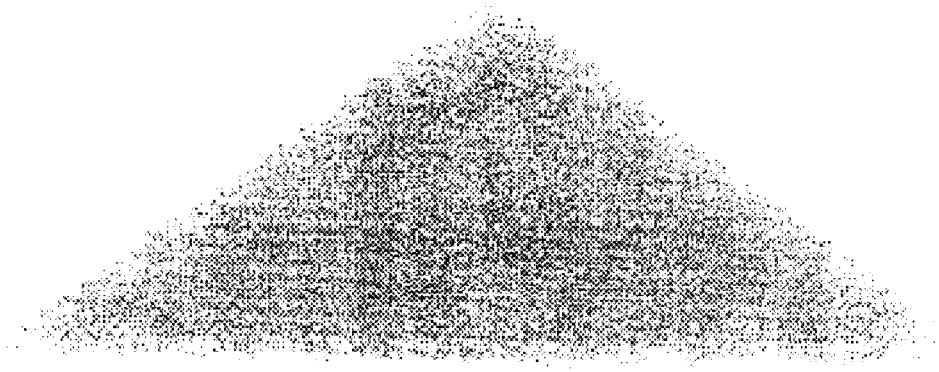
Figure 5:
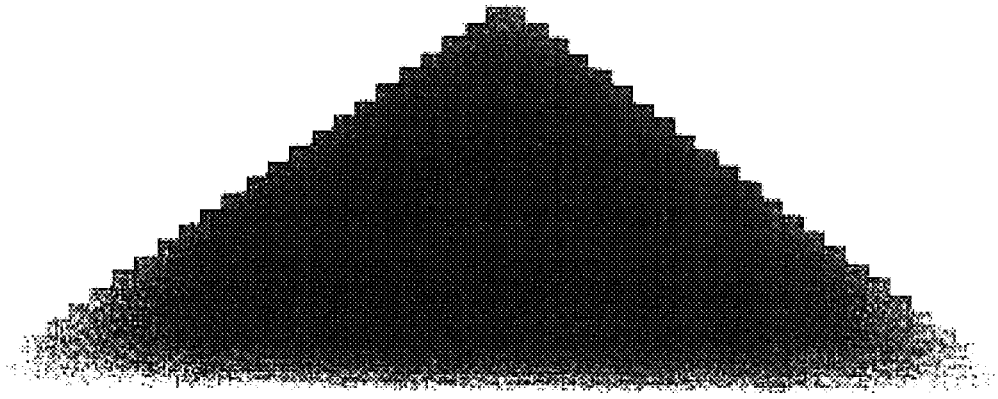
Figure 5:
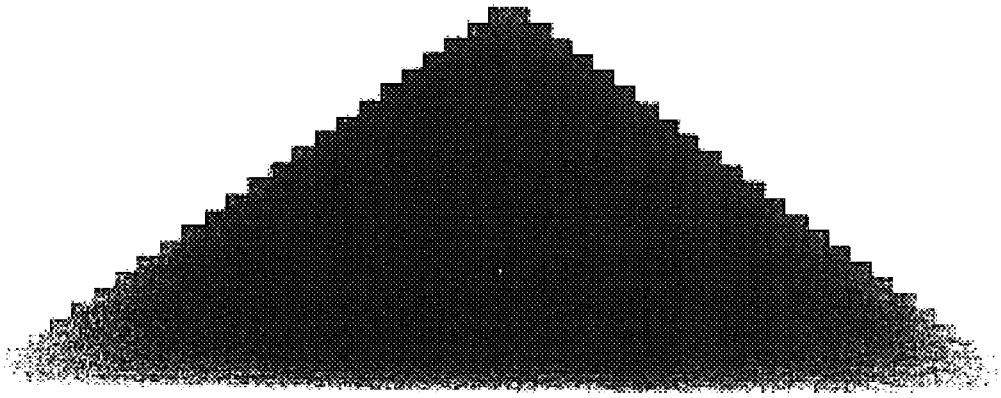

The heat energy gained per unit time by the element is equal to the sum of the heat absorption per unit time from microwave energy and the heat flow per unit time into or out of the element. The temperature of the element can then be determined by the following relationship:

$$\frac{dQ}{dt} = \frac{dQ_{abs}}{dt} - \frac{dQ_{ex-r}}{dt} - \frac{dQ_{ex-z}}{dt} = \frac{mC(T)dT}{dt} \tag{4}$$

where $$\frac{dQ}{dt}$$

is the net energy gain of the element at time t, and C(T) is the specific heat capacity of the raw powder mixture.

$$\frac{dQ}{dt}$$

controls the change of temperature dT of the element at time t. Obviously, the temperature of the element stays unchanged if $$\frac{dQ}{dt}$$

is equal to zero. It should be noted that both heat capacity and heat conductivity are temperature dependent and the temperature rises with heating time. The above four equations were, therefore, computed numerically, with a time interval of 0.1 seconds for a total heating time of 1 hour. The temperature profiles of the cones as a function of heating time were so obtained and an example of such profiles is shown in FIGS. 5(*a*)–(*c*) which show the temperature profile as a function of time calculated by the following numerical analysis.

The above analysis does make a number of assumptions. These include (1) that the microwave radiation is not significantly attenuated in the interior of the cone; (2) that heat loss from the surface of the cone by convection can be neglected; (3) that thermal conductivity of air dominates heat conduction within the sample; (4) the temperature of the chamber of the microwave oven was kept constantly at room temperature; and (5) that the susceptibility of the sample to microwave absorption does not change with temperature. These assumptions are all reasonable in the context.

In a specific example of an embodiment of the invention, microwave heating was used to produce a sample of the Bi2212 superconductor from its precursor materials $Bi_2O_3$ (99%), $SrCO_3$ (99%), $CaCO_3$ (99%) and CuO (99.995%). To begin with 5 g of each of the starting materials were shaped into cones using moulds. The base of the cone was supported on an alumina plate. The solid angle of the apex of the cone was 107°. An 800 W microwave oven operating at 2.45 GHz was used to heat these cones of powder, one at a time. The temperature was measured by inserting a thin (0.5 mm diameter) K-type thermocouple into the center of the cone before and after the irradiation. All temperature measurements after irradiation were done at 5 seconds after turning off the oven so as to provide a sufficient time period to operate the measurements. It is expected that the temperature decreased rapidly once the oven was off and this is the reason that the operation period (5 seconds) was standardized in this study for the sake of obtaining information on comparison basis.

The temperatures of the raw materials before and after irradiation are listed in Table I. Among these materials, only copper oxide showed strong absorption and became red hot within 1 minute. All other components, i.e. $Bi_2O_3$, $SrCO_3$, and $CaCO_3$ cannot be heated to elevated temperature with these experimental conditions.

TABLE 1

| Compound | Temp. before irradiation (° C.) | Temp. after irradiation (° C.) |
|---|---|---|
| $Bi_2O_3$ | 19 | 42 |
| $SrCO_3$ | 21 | 50 |
| $CaCO_3$ | 23 | 58 |
| CuO | 20 | >600 |

The starting materials listed in the last section were mixed according to the cation ratio of Bi:Sr:Ca:Cu=2:2:1:2. They were ground in agate mortar and pestle until thoroughly mixed. The mixtures were formed into cones by a mould as described above. The density of the cones was 0.53 g $cm^{-3}$, which was determined by measuring the weight and dimensions of the cones. A series of cones with different heights, hence different weights, were irradiated separately. During the irradiating process the samples can be observed directly since no additional thermal insulation material was used.

Figure 3:
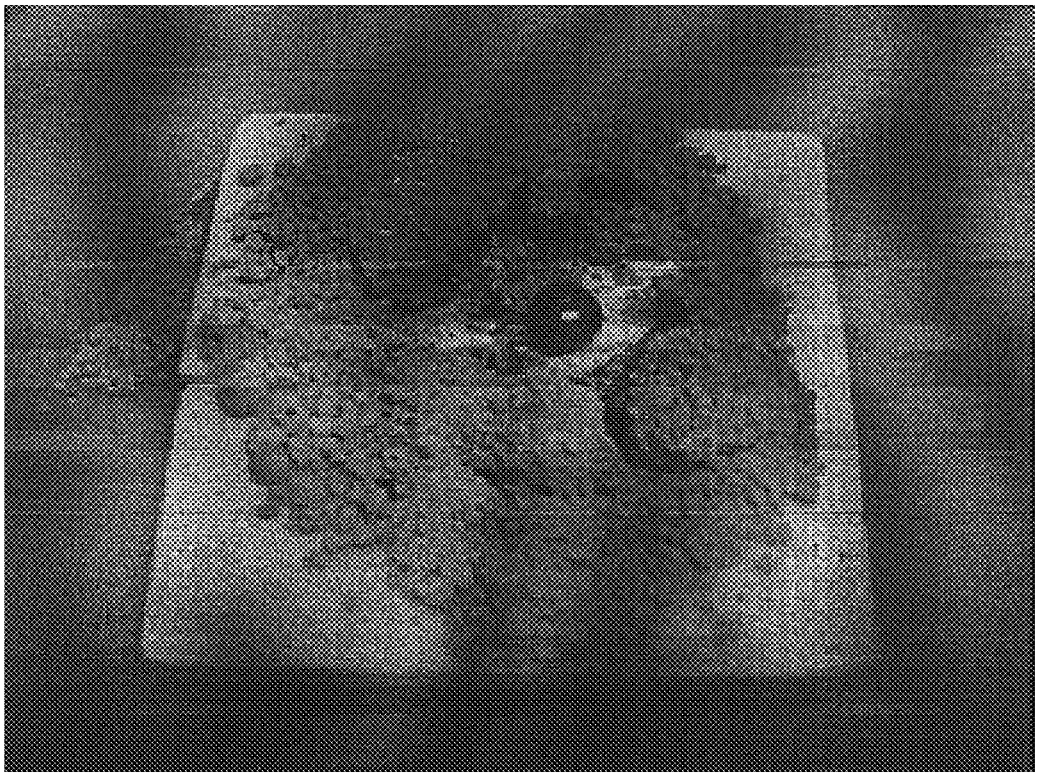
FIG. 3 is a photograph showing a sample of Bi2122 superconductor material formed by a method in accordance with an embodiment of this invention.
Figure 4:
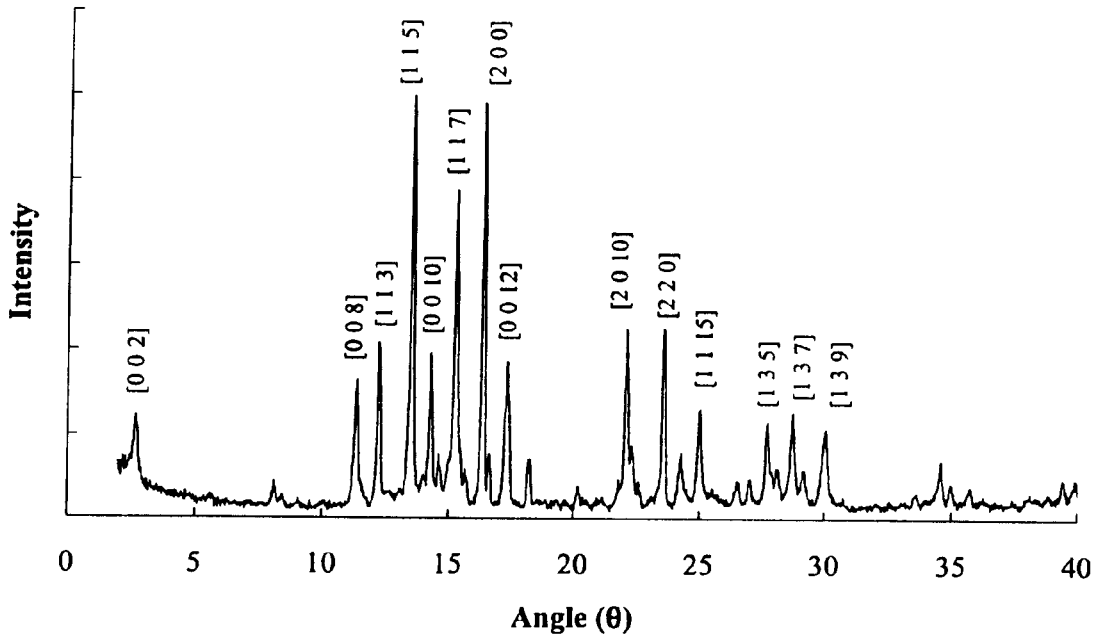
FIG. 4 is an X-ray diffraction spectrum of the material of FIG. 3, FIGS. 5(*a*)–(*c*) are cross-sectional temperature profiles as calculated by numerical modeling.

For bigger cones with mass above 1.7 g, vigorous reaction such as arcing and flaming occurred after about 1 minute of irradiation. For the cones with mass of 1.7 g or lighter, no observable reaction happened at the first 10 minutes except that the 1.7 g-cone became red hot slowly as irradiation time increased. After one hour of irradiation, the heating of this 1.7 g-cone was still apparently stable. Examination of the interior of the cone, after irradiation, found a black ellipsoidal solid, probably formed from the melt of the powder mixture (as shown in FIG. 3). The solid formed was hard and brittle with a glassy appearance. X-ray diffraction of the powder ground from these ellipsoids shows that they were amorphous. Ellipsoids so formed were annealed at 870° C. for 4 hours to form the superconducting phase. XRD on the annealed samples show standard Bi2212 patterns (as shown in FIG. 4).

These experimental results may be explained by a numerical computation, in which the cones are simulated as composed of N elements in the z direction and N elements in the r direction. Four values of N (10, 20, 50, and 100) have been calculated. Larger N or smaller element is expected to yield more accurate result. However, it was found that the results for N>50, such as N=100 do not improved the accuracy significantly. Consequently, the results shown in FIG. 5 are for N=50.

Figure 6:
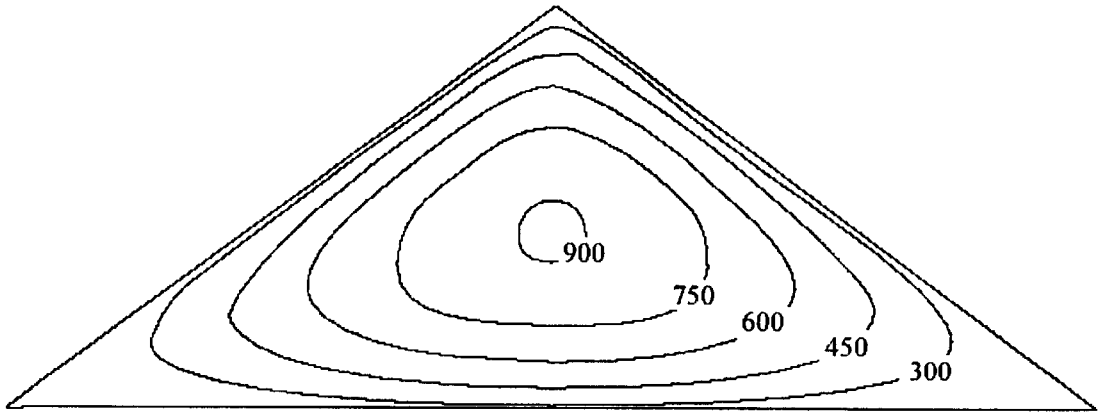
FIG. 6 shows an isotherm of a 1.7 g cone at equilibrium.

FIGS. 5(*a*)–(*c*) show the temperature profile as a function of irradiation time, t. Higher number of pixels per unit area was used to show higher temperature. The cone was modeled as 1.7 g by weight. The temperature of each element in the cone was the same at the early stages, e.g. at t=10 seconds, as shown in FIG. 5(*a*). The elements closer to the center became hotter than those closer to the surface as t increases. When t was increased to 60 seconds, as shown in FIG. 5(*b*), while the elements near the surface remained at low temperature, the temperatures of those near the center were raised although the temperature gradient was very gentle. Approaching the equilibrium stages, e.g. t=300 seconds as shown in FIG. 5(*c*), sharp temperature gradient was established from the surface to the center. The isotherm shown in FIG. 6 over 800° C. has an ellipsoidal shape which may explain the shape of products formed in the examples.

Figure 7:
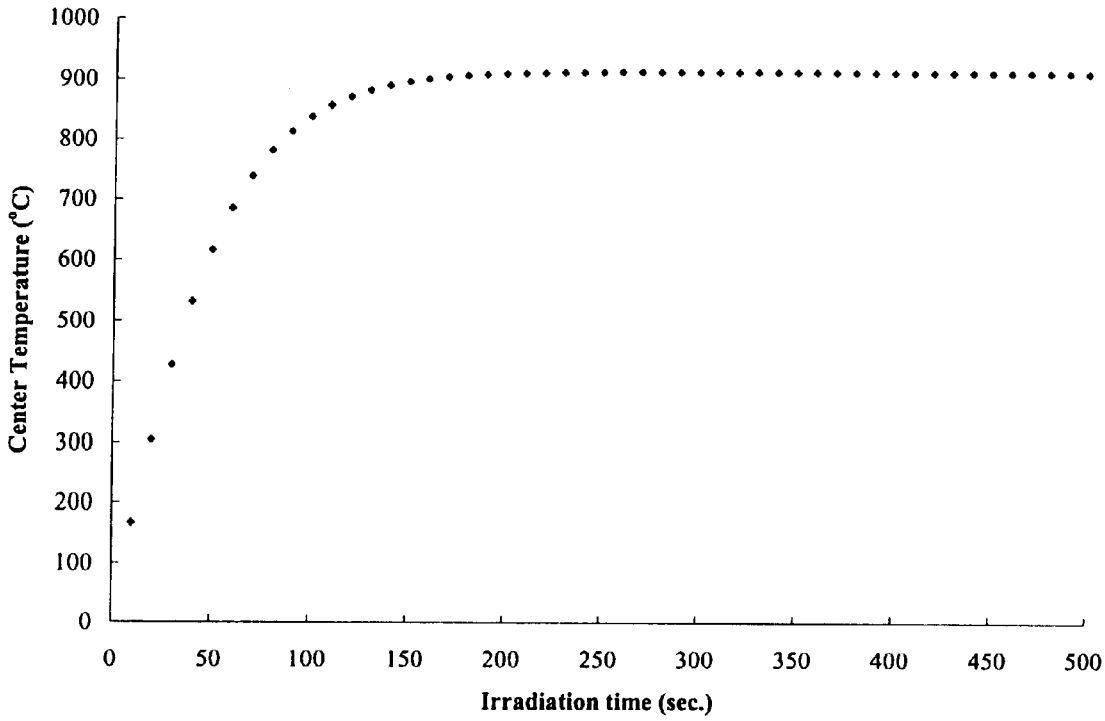
FIG. 7 is a plot of the temperature at the center of a 1.7 g cone as a function of irradiation time.
Figure 8:
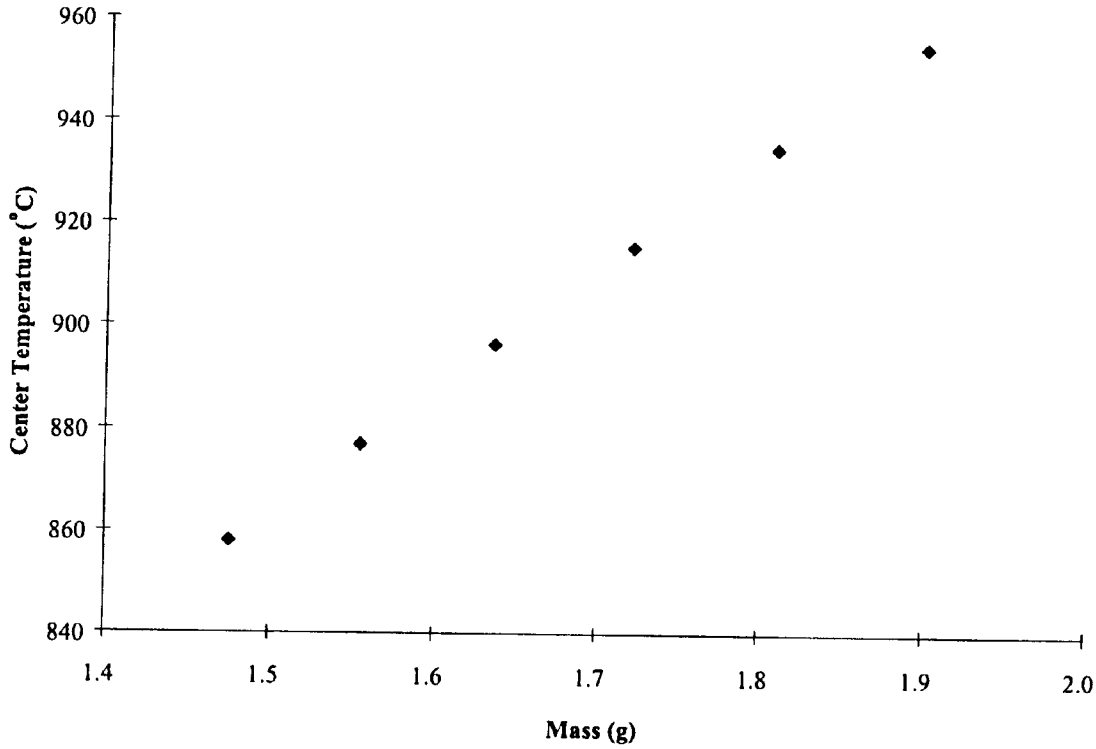
FIG. 8 is a plot of the ceiling temperature at the center of the cone as a function of mass.

With time, a ceiling temperature at the center of the cone is reached and the cone is in a state of thermal equilibrium (FIG. 7). Model cones of different masses were also calculated. FIG. 8 shows the ceiling temperatures at the centers of the cones for m=1.4 g to 1.9 g. Empirically, a rise of 20° C. follows each increment of 0.1 g. This indicates that the ceiling temperature is very sensitive to the mass of the sample. These results obtained from numerical modeling agree well with the experimental observations.

It will thus be seen that, at least in preferred embodiments, the present invention provides a method for microwave heating in which the temperature of the sample being heated is kept to a maximum by so designing the shape and dimensions of the sample that a state of thermal equilibrium is reached in which the microwave irradiation is matched by heat loss to the environment. If the parameters of the sample are chosen correctly, the state of thermal equilibrium can be chosen so that there is a desired maximum temperature of the sample depending on the heat processing that the sample is to undergo. The method avoids the need for any form of temperature measurement and feedback control of the microwave irradiation.

What is claimed is:

1. A method of processing a sample of material by microwave irradiation, wherein the sample is formed such that at least a part of the sample will reach a state of thermal equilibrium in which energy absorbed from the microwave irradiation is balanced by heat dissipated to the environment, and wherein the maximum temperature of the sample at which said state of thermal equilibrium is reached is controlled by varying sample parameters selected from the shape, dimensions, mass and density of the sample.

2. A method as claimed in claim 1 wherein said parameters are selected such that said maximum temperature is a temperature necessary for a desired processing step to be carried out.

3. A method as claimed in claim 1 wherein said sample is formed as a cone.

4. A method of forming a material by microwave heating, comprising the steps of:

(a) assembling precursor materials into a shape of selected form and dimensions, at least one of said precursor materials being susceptible of absorbing microwave radiation at at least one microwave frequency, and (b) irradiating said precursor materials with microwave radiation at said at least one frequency, wherein the form and dimensions of the shape into which the precursor materials are selected is chosen such that when said materials are subject to said microwave irradiation at least a part of said materials reaches a state of thermal equilibrium at which at least a part of said precursor materials are at a temperature sufficient to form said material.

5. A method as claimed into claims 4 wherein said shape is a cone.

6. A method as claimed in claim 5 wherein said microwave susceptible material is CuO and the microwave frequency is 2.45 GHz.

7. A method as claimed in claim 6 wherein the material so be formed is a Bi2122 superconducting material.

8. A method as claimed in claim 4 wherein said microwave susceptible material is CuO and the microwave frequency is 2.45 GHz.

9. A method as claimed in claim 8 wherein the material to be formed is a Bi2122 superconducting material.

* * * * *

UNITED STATES PATENT AND TRADEMARK OFFICE

CERTIFICATE OF CORRECTION

PATENT NO. : 6,713,738 B2
DATED : March 30, 2004
INVENTOR(S) : Yau et al.

It is certified that error appears in the above-identified patent and that said Letters Patent is hereby corrected as shown below:

Column 8,
Line 19, delete “5” and insert -- 4 --
Line 22, delete the word “so” and insert -- to --.

Signed and Sealed this

Tenth Day of August, 2004

JON W. DUDAS
*Acting Director of the United States Patent and Trademark Office*